US005330711A

United States Patent [19]

Snider

[11] Patent Number: 5,330,711

[45] Date of Patent: Jul. 19, 1994

[54] NICKEL BASE ALLOYS FOR CASTINGS

[75] Inventor: Raymond G. Snider, Derby, England

[73] Assignee: Rolls-Royce plc, London, United Kingdom

[21] Appl. No.: 927,497

[22] PCT Filed: Feb. 6, 1992

[86] PCT No.: PCT/GB92/00228

§ 371 Date: Sep. 29, 1992

§ 102(e) Date: Sep. 29, 1992

[30] Foreign Application Priority Data

Feb. 7, 1991 [GB] United Kingdom ..... 9102642

[51] Int. Cl.[5] ..... C22C 19/05

[52] U.S. Cl. ..... 420/448; 148/410

[58] Field of Search ..... 420/448; 148/410, 428

[56] References Cited

U.S. PATENT DOCUMENTS

| | | | |
|---|---|---|---|
| 3,902,862 | 9/1975 | Moll et al. . | |
| 4,160,665 | 7/1979 | Terekhov et al. . | |
| 4,492,672 | 1/1985 | Duhl et al. | 420/448 |
| 4,608,094 | 8/1986 | Miller et al. | 148/677 |
| 4,810,467 | 3/1989 | Wood et al. | 148/410 |
| 4,908,069 | 3/1990 | Doherty et al. . | |
| 4,908,183 | 3/1990 | Chin et al. . | |
| 5,143,563 | 9/1992 | Krueger et al. | 148/410 |

FOREIGN PATENT DOCUMENTS

| | | |
|---|---|---|
| 0225837 | 6/1987 | European Pat. Off. . |
| 0312966 | 4/1989 | European Pat. Off. . |
| 3921626 | 11/1989 | Fed. Rep. of Germany . |
| 2199002 | 4/1974 | France . |
| 2075057 | 11/1981 | United Kingdom . |

OTHER PUBLICATIONS

Great Britain (II) 2220,676 Jan. 1990.
Great Britain (III) 2,148,323 May 1985.

*Primary Examiner*—Richard Dean
*Assistant Examiner*—Margery S. Phipps
*Attorney, Agent, or Firm*—Oliff & Berridge

[57] ABSTRACT

A nickel-base casting alloy for use in gas turbine components consists essentially of the composition (in weight percent): carbon 0.02–0.15, chromium 14–18, cobalt 8–12, aluminum 0.5–1.5, titanium 2.0–3.5, niobium 3.5–6.0, tantalum 1.0–2.0, tungsten 1.0–3.0, molybdenum 3.0–6.0, boron 0.002–0.05, zirconium 0.01–0.1, balance nickel and incidental impurities. The alloy is characterized by a volume fraction of gamma prime of about 32%, an ultimate tensile strength in the range 990–1010 MPa over the temperature range 550°–750° C., and a mean coefficient of linear thermal expansion in the range 11.5–15.0 alpha(*E–06/°C.).

9 Claims, 7 Drawing Sheets

NICKEL BASE ALLOYS FOR CASTINGS

This invention relates in a first aspect to a nickel base alloy suitable for making castings and in a second aspect to a casting made from such an alloy. The invention relates in particular to a high strength, weldable casting alloy, having superior stress rupture, tensile and fatigue properties.

BACKGROUND OF THE INVENTION

Cast nickel-base alloys and in particular the so-called nickel-base superalloys have been widely used in applications where resistance to high temperatures is required. Such applications are largely found in the hotter parts of gas turbine engines, in particular vanes and blades in aircraft engines. Superalloy castings have also been favoured for lower temperature (c. 600° C.) applications for static structural parts such as casings, compressor and turbine exit guide vanes and bearing housings. For such applications, in addition to good creep resistance, weldability, fatigue resistance and low thermal expansion properties are required.

The compositions of such superalloys are chosen to meet specific engine requirements, and it is generally recognized that improvement in one property of a superalloy is usually at the expense of one or more other properties. For instance, it is difficult to make a nickel-base superalloy possessing good casting and welding properties whilst at the same time exhibiting high tensile strength and creep resistance.

Alloying elements in nickel-base superalloys have various roles, which may be summarised as follows.

Typically, nickel-base superalloys consist of the following phases:

1) Gamma matrix phase. This is typically high in nickel, chromium, cobalt, tungsten, and molybdenum. Rhenium and ruthenium may also be present in some applications. Nickel, cobalt, chromium, tungsten, molybdenum, and rhenium all affect the properties of the superalloy matrix.

2) Gamma prime precipitate strengthening phase. This is typically high in nickel, aluminum, titanium, niobium, tantalum, and vanadium. Some chromium and cobalt will be present. Hafnium will be present in the gamma prime phase in alloys that contain hafnium. The properties of the gamma prime phase are affected by the presence of these elements.

The gamma matrix is hardened by large, heavy, refractory elements (e.g. tungsten, molybdenum, rhenium) which distort the crystal structure—i.e. solid solution strengthening. The limits of addition of these elements is indicated by the onset of phase instability, where embrittling phases occur. This limit is predicted by a phase computation procedure which is known in the prior art whereby freedom from formation of embrittling phases is predicted if the composition has a low calculated value of the average electron vacancy number (Nv) of the matrix. Such refractory elements also slow down chemical diffusion which is beneficial for weldability and in controlling creep.

The gamma prime precipitate is hardened by the elemental content. The important feature of the precipitate is that it imparts strength to the matrix. The strength of the structure is a function of the amount of precipitate present, its size and shape distribution, and the stability of the structure in service. All of these factors are affected by the chemical balance.

Grain boundaries are strengthened by the presence of carbon, boron, hafnium and zirconium, and carbides such as those of chromium, tungsten, molybdenum, titanium, tantalum, niobium, vanadium, and hafnium.

It is desirable for good castability of a superalloy that it has a moderate freezing range of about 80° C. to give low porosity. Low boron, zirconium, and carbon content gives hot tear and weld fissure resistance. A low carbide content during solidification gives low porosity.

Good weldability of a superalloy is indicated by a low aluminum/titanium ratio and low aluminum plus titanium total contents since this gives a low gamma prime volume fraction producing a weaker, more ductile alloy which is better able to accomodate the stresses produced during the weld thermal cycle. However, alloys of this nature are often weak and not suitable for higher performance turbine engine components.

Another approach is to employ precipitate strengthening elements (such as niobium) which have a low diffusivity in a low diffusivity matrix (i.e. containing refractory elements). This has been done in an alloy known in the prior art, IN718. This alloy, which is described in British Patent 2148323, has for a number of years been notably successful as a casting alloy used for many components in gas turbine engines. However, in order to operate designs at higher temperatures it is desirable to provide an alloy with higher temperature capability (IN718 is limited to about 650° C.), higher strength and good weldability.

The benefit in strength over IN718 can be achieved by selecting a balanced chemistry (as described above) but it is necessary also to optimise the gamma prime volume fraction of the alloy such that weldability can be maintained. It is also necessary to optimise the gamma/gamma prime mismatch by controlling the refractory element content of the matrix/precipitate.

A low gamma/gamma prime mismatch leads to good precipitate stability and resistance to creep at high temperatures (greater than 800° C.). However, for lower temperature operation a larger mismatch is preferred as strengthening is gained by the presence of large. coherency strains.

It is also known that a high chromium content limits the upper working temperature of the alloy, and this effect is usually counteracted by cobalt (as in the alloy IN939 which has a chromium content of 22% and a cobalt content of about 19%). It should be possible to gain a benefit in upper working temperature for an alloy by limiting the chromium content to about 16%, whilst still maintaining an adequate level of corrosion resistance.

SUMMARY OF THE INVENTION

It is an object of the present invention to provide a nickel-base superalloy that has good casting and welding properties whilst possessing superior tensile strength, stress rupture properties and fatigue resistance, and a low coefficient of thermal expansion.

In the present specification compositions will be given as weight percent, unless otherwise indicated.

According to a first aspect of the present invention there is provided a nickel-base casting alloy consisting essentially of the composition, by weight percent: carbon 0.02–0.15, chromium 14–18, cobalt 8–12, aluminum 0.5–1.5, titanium 2.0–3.5, niobium 3.5–6.0, tantalum 1.0–2.0, tungsten 1.0–3.0, molybdenum 3.0–6.0, boron 0.002–0.05, zirconium 0.01–0.1, balance nickel and incidental impurities.

Preferably, the composition range comprises: carbon 0.03–0.07, chromium 15–17, cobalt 9–11, aluminum 0.7–1.2, titanium 2.0–3.0, niobium 4.0–5.5, tantalum 1.3–1.5, tungsten 1.5–2.5, molybdenum 3.5–5.5, boron 0.004–0.006, zirconium 0.01–0.014, balance nickel and incidental impurities.

The most preferred composition of the alloy comprises: carbon 0.05, chromium 16, cobalt 10, aluminum 0.9, titanium 2.7, niobium 4.9, tantalum 1.4, tungsten 2, molybdenum 4.9, boron 0.005, zirconium 0.01, balance nickel and incidental impurities.

Preferably the $Vf_{\gamma'}$ (volume fraction of gamma prime) is about 32.

Preferably, the Nv value (electron vacancy number) is about 2.39.

Preferably, the alloy has a typical ultimate tensile strength in the range 990–1010 MPa over the temperature range 550°–750° C.

Preferably, the alloy has a mean coefficient of linear thermal expansion in the range 11.9–14.8 alpha(*E-06/°C.) over the temperature range from room temperature to 900° C.

According to a second aspect of the present invention there is provided a casting cast from an alloy according to the first aspect.

The casting may be a component for a gas turbine engine.

The invention will now be described by way of example only with reference to the accompanying Tables (at the end of the specification) and Figures.

BRIEF DESCRIPTION OF THE DRAWINGS

The Figures display graphs of various properties of superalloys, showing comparisons between superalloy compositions of the invention and known compositions, as follows.

The specific composition within the scope of the invention will be referred to hereinafter as RS5.

Alloys referred to hereinafter as RS1 and RS4, whilst outside the scope of the present invention, were candidate compositions in the exercise to develop the new alloy but did not show the required level of weldability.

Compositions of superalloys of the prior art used in comparison tests in this specification are shown in Table 1. Compositions of superalloys of the invention are shown in Tables 2 and 3.

Table 4 shows a comparison of characteristics between alloys of the prior art and the alloy of the invention.

Table 5 shows the results of comparative weldability trials.

A nickel-base alloy according to the present invention was made in accordance with the following Example.

DESCRIPTION OF THE PREFERRED EMBODIMENTS

Example

A charge consisting of the elements listed under RS5 in Table 2 was prepared and melted in a vacuum furnace. The melt was poured into a mould adapted to produce a test bar casting, and the rate of solidification and conditions of casting were controlled so as to produce an equiaxed grain structure in the casting. The techniques for casting equiaxed alloy components are well known to the man skilled in the art and need not be described here. The cast bars were heat treated by heating at 1160° C. for between 1 and 5 hours followed by heating at 800° C. for 16 hours. The initial heat treatment temperature of 1160° C. was chosen as being a suitable temperature in the range 1150° C. to the solidus of the alloy. The alloy of the casting was found to have a density of 8.52 gm/cc.

Alloys in accordance with the present invention are hardened with gamma prime precipitates of the general form $Ni_3M$ where M is selected from the group consisting of aluminum, titanium, niobium and tantalum. The combination of elements is balanced to give an optimum gamma/gamma prime lattice mismatch. A low lattice mismatch ensures stable gamma prime precipitates at high temperatures (greater than 800° C.), thereby providing high temperature strength. However, at intermediate temperatures a higher mismatch promotes strengthening due to the large coherency strains present.

Figure 1:
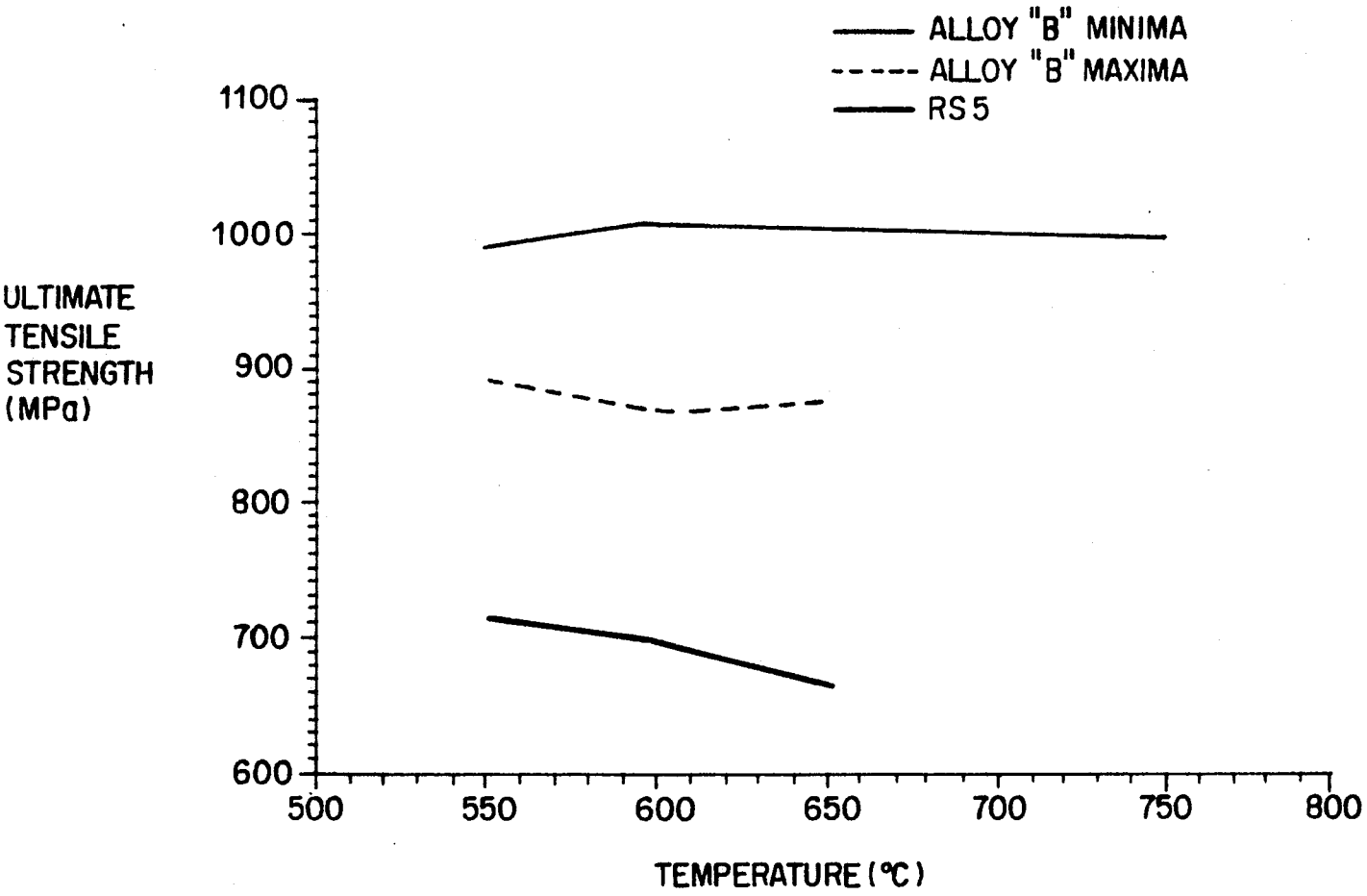
FIG. 1 is a graph between temperature and ultimate tensile strength.

With reference to FIG. 1, standard tensile strength tests were carried out over a range of temperatures on identical components made from Alloys A and B of the prior art and from Alloy RS5 (the preferred alloy) of the invention. The graph shows that RS5 is substantially superior to the other alloys tested.

Figure 2:
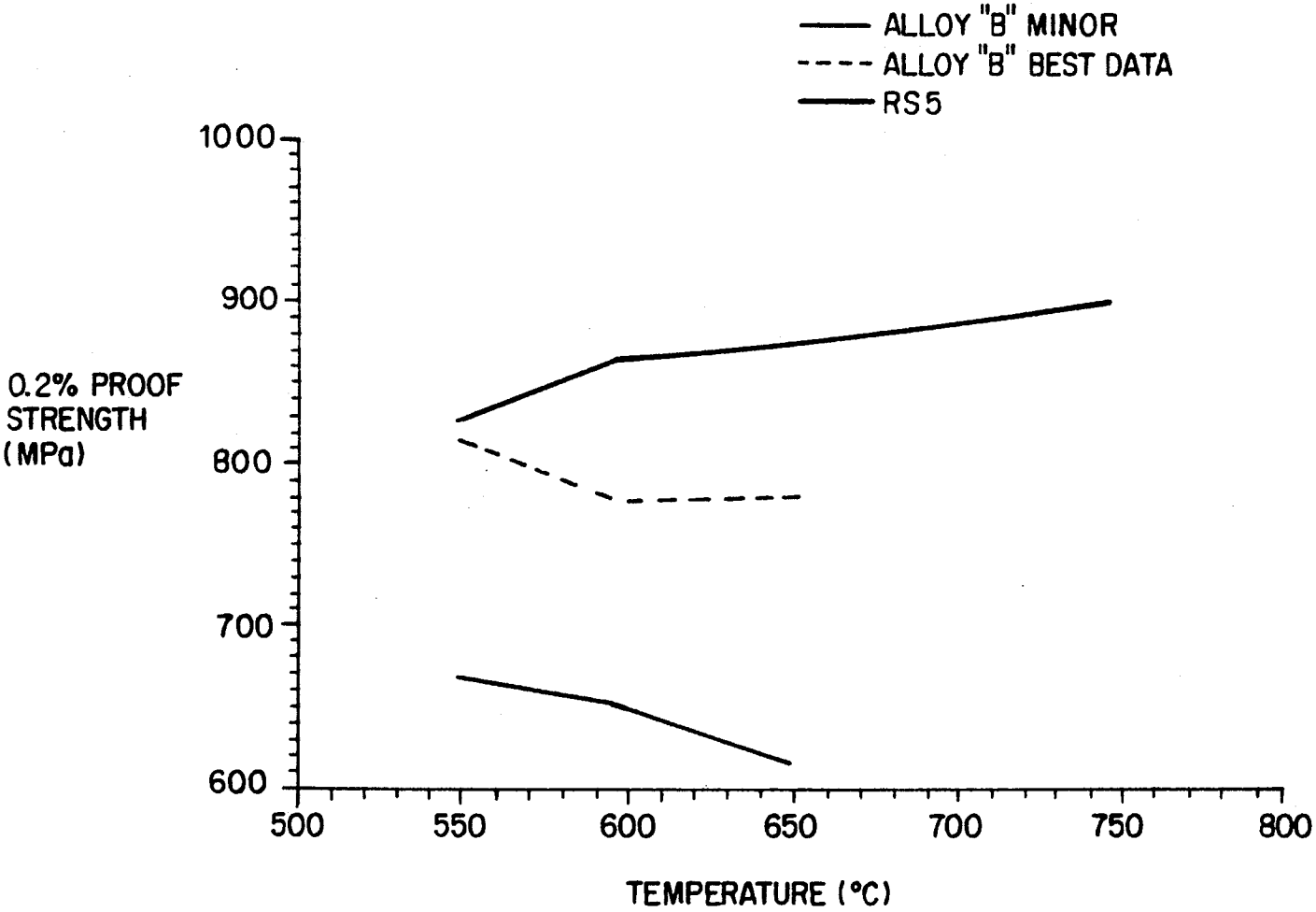
FIG. 2 is a graph between temperature and 0.2% proof strength.

The graph of FIG. 2 shows the tensile 0.2% proof strengths of components made from Alloys A and B of the prior art, and from Alloy RS5 of the invention. Although RS5 is not significantly better than Alloy B at lower temperatures, it will be seen that at higher temperatures the strength of Alloy B deteriorates whilst that of RS5 increases. RS5 is significantly superior to Alloy B at higher temperatures.

Figure 3:
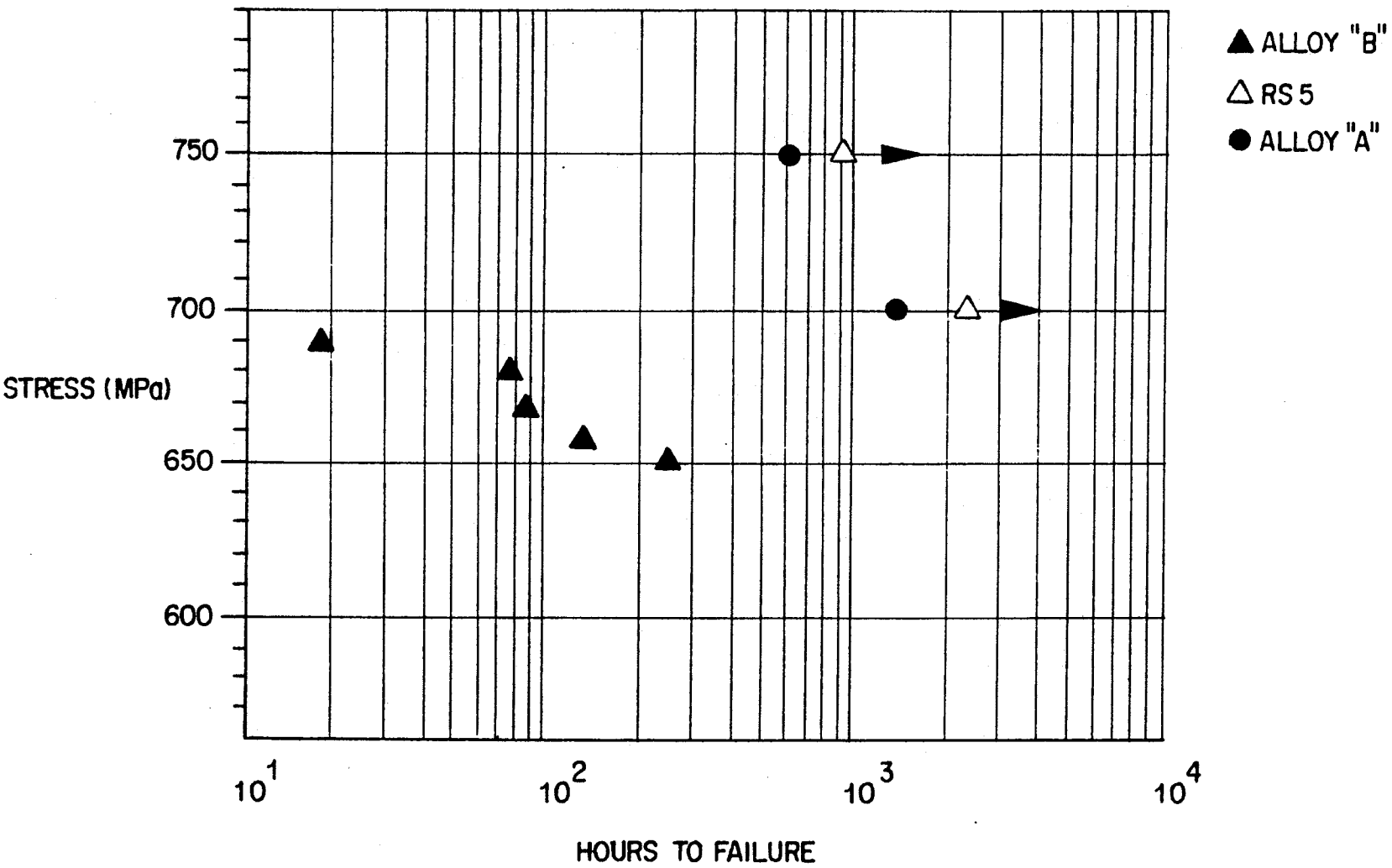
FIG. 3 is a graph between hours to failure and stress applied at 650° C.
Figure 4:
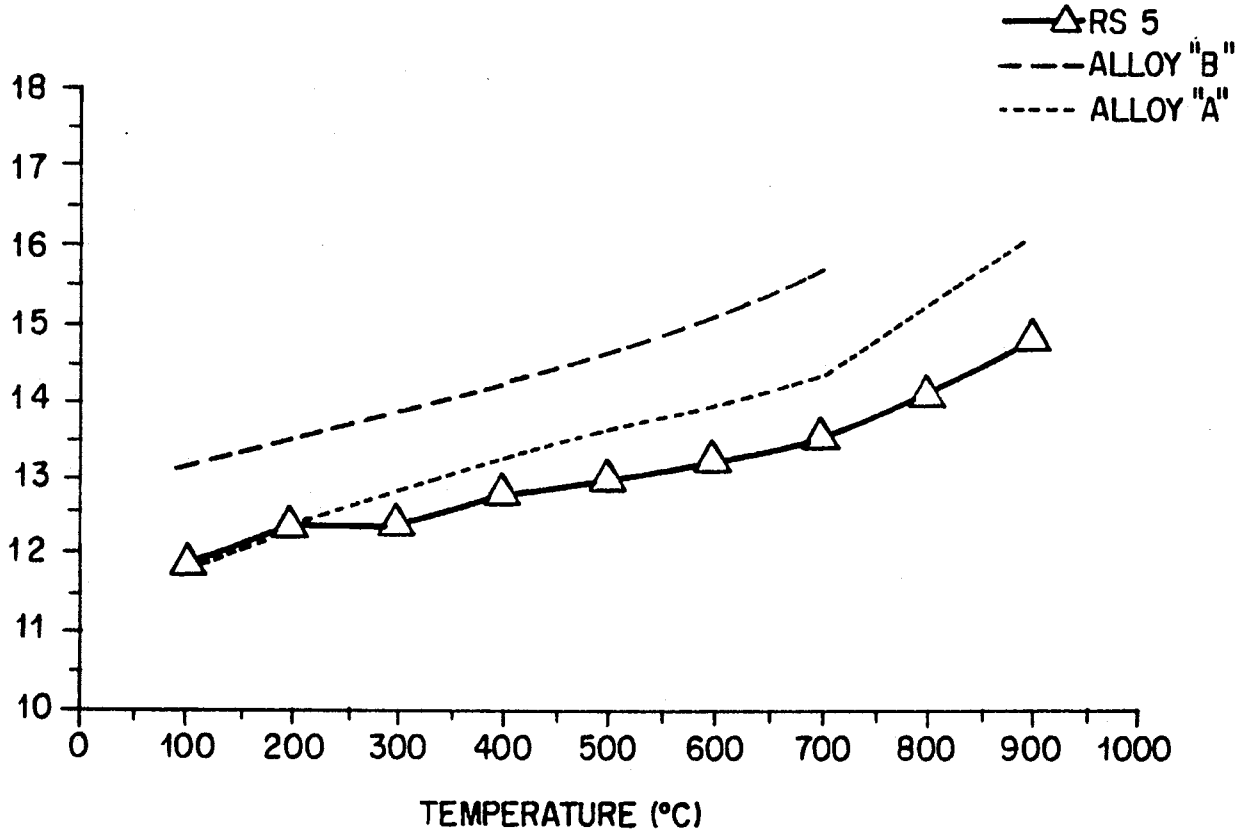
FIG. 4 is a graph between temperature and the mean coefficient of linear expansion.

FIG. 3 shows the results of standard stress rupture tests carried out at 650° C. on components cast from Alloys A and B of the prior art, and from Alloy RS5 of the invention. It will be seen that RS5 comfortably exceeds the lives of Alloys A and B in these tests.

The mean coefficient of linear thermal expansion was measured over a temperature range from room temperature to 900° C. for Alloys A and B of the prior art, and Alloy RS5 of the invention. RS5 clearly has a substantially lower coefficient than those of the prior art alloys tested. The significance of this is that moving engine components made from RS5 can operate at much closer tolerances at elevated temperatures than hitherto, hence minimizing gas leakage between moving and stationary parts and thus improving engine efficiency.

Figure 5:
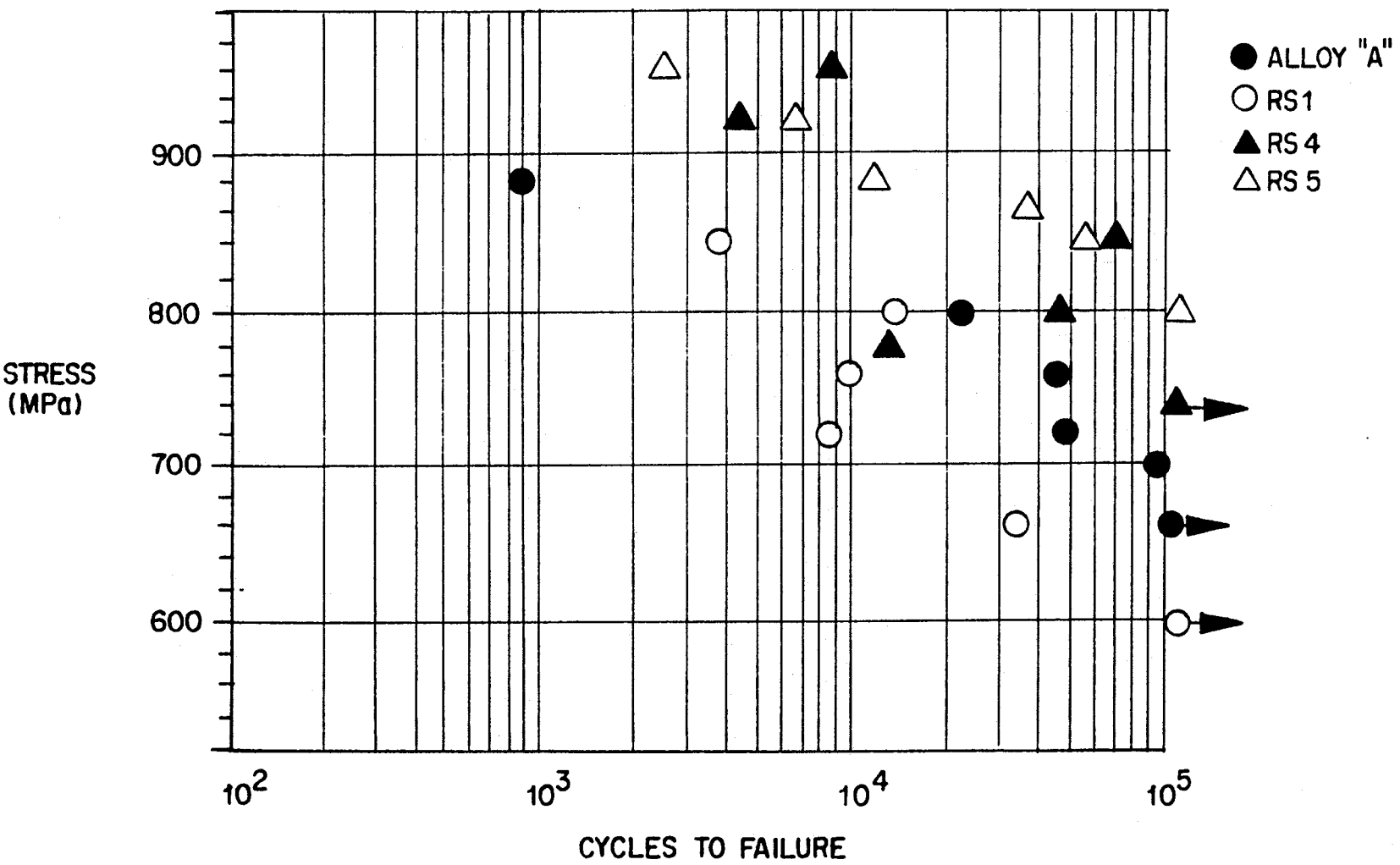
FIGS. 5 and 6 are graphs between fatigue cycles to failure and stress.
Figure 6:
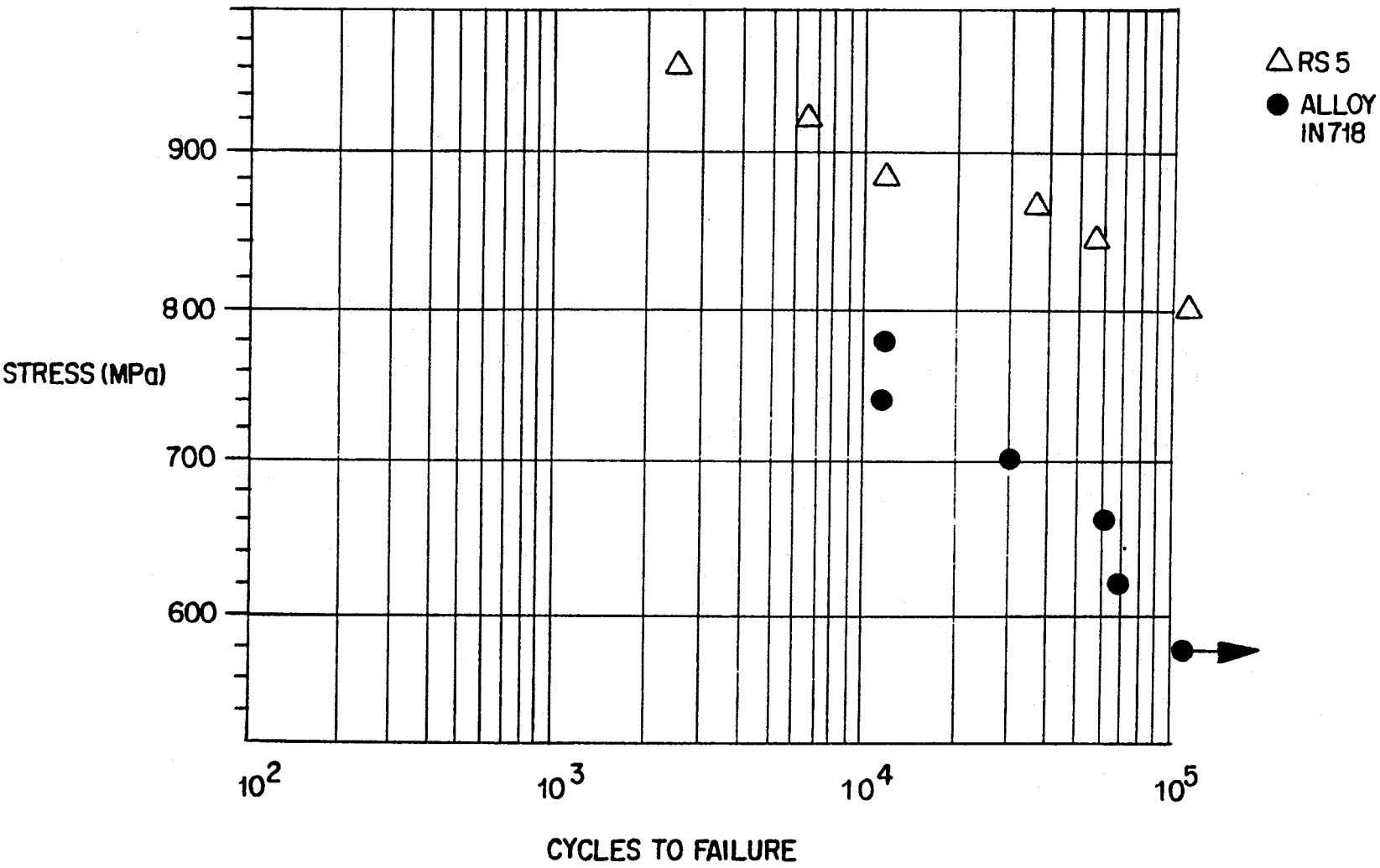

FIGS. 5 and 6 show the results of low cycle fatigue tests at 600° C. for Alloys A and B of the prior art, and Alloys RS1, RS4 and RS5. RS4 and RS5 last as long at higher stresses as Alloys A and B do at lower stresses. RS1 is not significantly worse than the tested alloys of the prior art.

Figure 7:
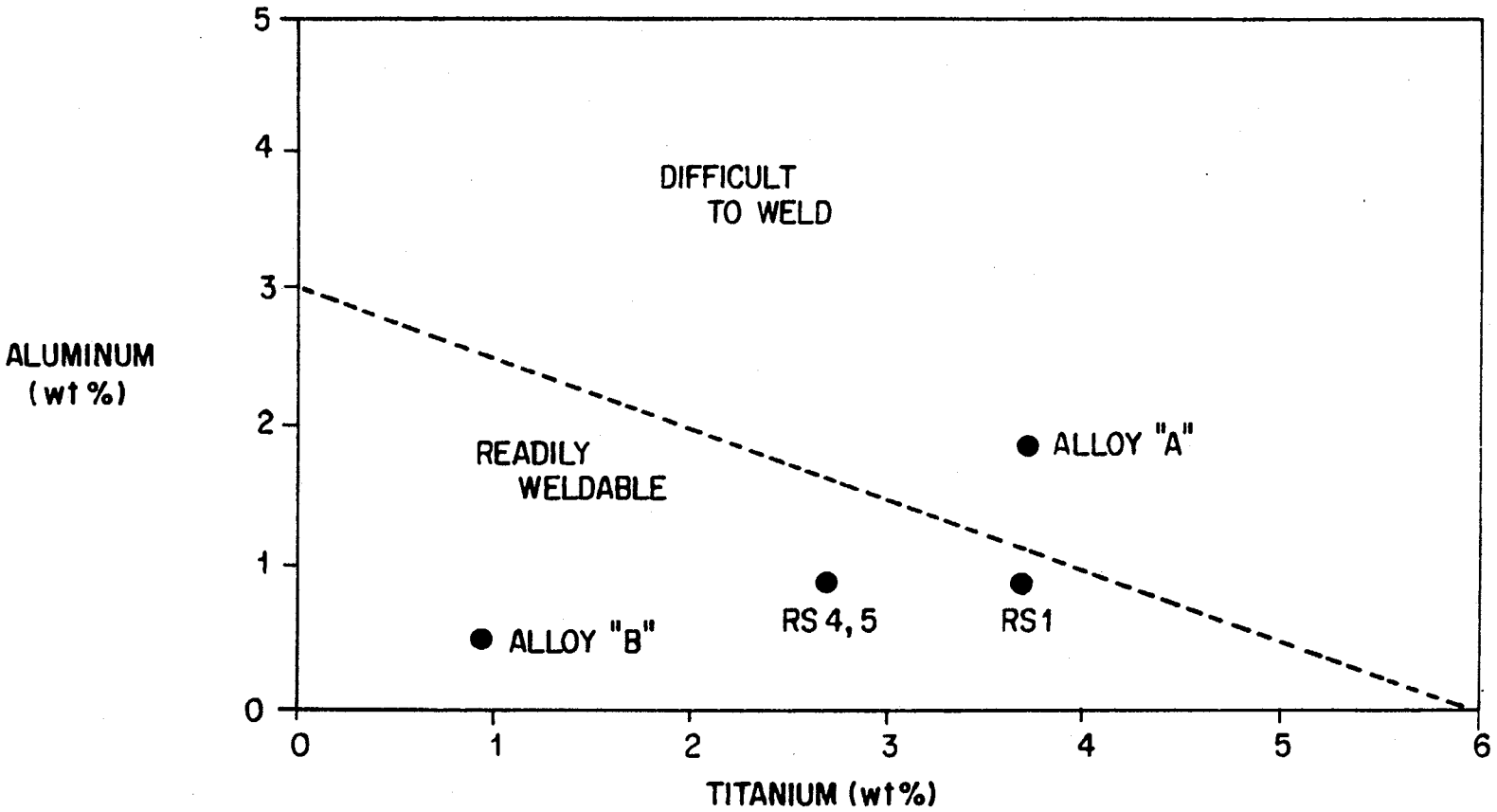
FIG. 7 is a scatter diagram of superalloy weldability versus composition.

FIG. 7 is a scatter chart comparing weldability of Alloys RS1, RS4 and RS5 (RS5 being of the invention) with Alloys A and B of the prior art, as a function of aluminum/titanium content. The dotted line given by the linear equation $$\text{aluminum} = 3 - \text{titanium}/2$$

separates the difficult-to-weld compositions from the readily-weldable compositions. The alloys of the invention are clearly at least as weldable as their prior art counterparts.

Weldability trials were carried out on plates made from Alloy A of the prior art, and from Alloys RS1, RS4 and RS5 of the invention. The results are shown in Table 5. The weld-as solution h/t column shows the results of heat treating the welded plates for 1 hour at 800° C. Only RS5 was able to withstand this treatment without cracking, but plates made from all three alloys of the invention were crack free as welded. The difference between Alloys RS4 and RS5 is the addition of 4.9% molybdenum to RS5 and it is seen that this addition has had a potent effect in improving weldability.

It will be seen therefore that alloys in accordance with the present invention have good castability, high tensile strength at elevated temperatures, weldability, high resistance to stress rupture, and a desirably low mean coefficient of linear thermal expansion.

TABLE 1

| | Superalloys of the prior art | |
|---|---|---|
| ELEMENT | A | B |
| carbon | 0.15 | 0.04 |
| chromium | 22 | 18.6 |
| cobalt | 19 | — |
| aluminum | 1.90 | 0.4 |
| titanium | 3.70 | 0.9 |
| niobium | 1.0 | 5.0 |
| tantalum | 1.4 | — |
| tungsten | 2.00 | — |
| molybdenum | — | 3.1 |
| boron | 0.01 | — |
| zirconium | 0.1 | — |
| iron | — | 18.5 |
| nickel | BALANCE | BALANCE |

Alloy A is described in British Patent 1367661 and Alloy B is described in U.S. Pat. No. 3046108.

TABLE 2

| | Superalloys of the invention | | |
|---|---|---|---|
| ELEMENT | BROAD RANGE | NARROW RANGE | PREFERRED (RS5) |
| carbon | 0.02–0.15 | 0.03–0.07 | 0.05 |
| chromium | 14–18 | 15–17 | 16 |
| cobalt | 8–12 | 9–11 | 10 |
| aluminum | 0.5–1.5 | 0.7–1.2 | 0.9 |
| titanium | 2.0–3.5 | 2.0–3.0 | 2.7 |
| niobium | 3.5–6.0 | 4.0–5.5 | 4.9 |
| tantalum | 1.0–2.0 | 1.3–1.5 | 1.4 |
| tungsten | 1.0–3.0 | 1.5–2.5 | 2 |
| molybdenum | 3.0–6.0 | 3.5–5.5 | 4.9 |
| boron | 0.002–0.05 | 0.004–0.006 | 0.005 |
| zirconium | 0.01–0.1 | 0.01–0.014 | 0.01 |
| nickel | BALANCE | BALANCE | BALANCE |

The "BALANCE" in each range consists of nickel and incidental impurities.

TABLE 3

| | Superalloys studied in the course of making the invention. | | |
|---|---|---|---|
| ELEMENT | RS1 | RS4 | RS5 |
| carbon | 0.04 | 0.04 | 0.05 |
| chromium | 22.27 | 15.87 | 16 |
| cobalt | 19.16 | 10.04 | 10 |
| aluminum | 1.11 | 1.02 | 0.9 |
| titanium | 3.72 | 2.75 | 2.7 |
| niobium | 0.98 | 4.97 | 4.9 |
| tantalum | 1.46 | 1.42 | 1.4 |
| tungsten | 2.02 | 2.01 | 2 |
| molybdenum | — | — | 4.9 |
| boron | 0.006 | 0.005 | 0.005 |
| zirconium | 0.011 | 0.013 | 0.01 |
| nickel | BALANCE | BALANCE | BALANCE |

TABLE 4

| | Characteristics | | |
|---|---|---|---|
| ALLOY | Nv | Vfγ' | gamma/gamma prime mismatch |
| A | 2.50 | 34 | 0.68 |
| RS1 | 2.36 | 28.1 | 0.92 |
| RS4 | 1.93 | 32.9 | 1.88 |
| RS5 | 2.39 | 32.7 | 1.53 |

TABLE 5

| | Weldability | |
|---|---|---|
| ALLOY | WELD-AS CAST | WELD-AS SOLUTION H/T (4 hours/1160° C.) |
| A | cracked | badly cracked |
| RS1 | crack free | cracked |
| RS4 | crack free | cracked |
| RS5 | crack free | crack free |

I claim:

1. A nickel-base casting alloy, consisting essentially of the composition, by weight percent: carbon 0.05, chromium 16, cobalt 10, aluminum 0.9, titanium 2.7, niobium 4.9, tantalum 1.4, tungsten 2, molybdenum 4.9, boron 0.005, zirconium 0.01, balance nickel and incidental impurities.

2. The alloy of claim 1 wherein the alloy has a $Vf_{\gamma}'$ value (volume fraction of gamma prime) in the range 25–40%.

3. The alloy of claim 2 wherein the $Vf_{\gamma}'$ value is about 32.

4. The alloy of claim 1 wherein the Nv value (electron vacancy number) is about 2.39.

5. The alloy of claim 1 wherein the alloy has a typical ultimate tensile strength in the range 990–1010 MPa over the temperature range 550°–750° C.

6. An alloy of claim 1 wherein the alloy has a mean coefficient of linear thermal expansion in the range 11.9–14.8 alpha(*E-06/°C.) over the temperature range from room temperature to 900° C.

7. The alloy of claim 1, wherein the alloy forms a casting.

8. The alloy of claim 7, wherein the casting is a component of a gas turbine engine.

9. The alloy of claim 7 wherein the casting is heat treated at a temperature between 1150° C. and the alloy solidus for between one and five hours followed by heating at 800° C. for 16 hours.

* * * * *